United States Patent [19]

Muramatsu et al.

[11] Patent Number: 4,534,517

[45] Date of Patent: Aug. 13, 1985

[54] METHOD OF AUTOMATIC DOFFING IN A SPINNING UNIT

[75] Inventors: Shigeru Muramatsu, Okazaki; Isao Asai, Toyota; Takayuki Morita, Kariya, all of Japan

[73] Assignee: Kabushiki Kaisha Toyoda Jidoshokki Seisakusho, Kariya, Japan

[21] Appl. No.: 540,492

[22] Filed: Oct. 11, 1983

[30] Foreign Application Priority Data

Oct. 13, 1982 [JP] Japan ..... 57-179480

[51] Int. Cl.[3] ..... B65H 54/26; B65H 67/04

[52] U.S. Cl. ..... 242/35.5 A; 57/270

[58] Field of Search ..... 242/35.5 A, 35.5 R, 242/35.6 R, 18 R, 18 DD; 57/266, 268, 270, 271

[56] References Cited

U.S. PATENT DOCUMENTS

| | | | |
|---|---|---|---|
| 3,820,730 | 6/1974 | Endo et al. | 242/35.5 A X |
| 3,855,771 | 12/1974 | Yoshizawa et al. | 242/35.5 A X |
| 3,879,925 | 4/1975 | Yoshizawa et al. | 242/35.5 A |
| 3,948,452 | 4/1976 | Burysek et al. | 242/35.5 A X |
| 4,015,786 | 4/1977 | Slavik et al. | 242/35.5 A |
| 4,139,162 | 2/1979 | Stahlecker | 242/35.5 A |

FOREIGN PATENT DOCUMENTS

| | | | |
|---|---|---|---|
| 2640312 | 3/1978 | Fed. Rep. of Germany | 242/35.5 A |
| 2816418 | 10/1979 | Fed. Rep. of Germany | 242/35.5 A |
| 113662 | 9/1981 | Japan | 242/35.5 A |
| 132269 | 10/1981 | Japan | 242/35.5 A |
| 132271 | 10/1981 | Japan | 242/35.5 A |
| 2039552 | 8/1980 | United Kingdom | 242/35.5 A |

*Primary Examiner*—Stanley N. Gilreath

*Attorney, Agent, or Firm*—Brooks Haidt Haffner & Delahunty

[57] ABSTRACT

Method of automatic doffing in a spinning unit is disclosed. Automatic doffing apparatus for use in practicing the method includes a bobbin loading device for carrying an empty bobbin to a donning position in the spinning unit, and the loading device has a pushing member which is movable with the loader. As the package is released from a bobbin holder and then supported adjacently to the bobbin holder, the loading device is moved forwardly toward the donning position. On the way to the donning position, the loading device pushes the supported package away from the donning area with its pushing member. The bobbin brought to a donning position is held by the bobbin holder. According to the method, unloading of a package and loading of an empty bobbin is made by a single motion, or advancing, of the bobbin loading device.

11 Claims, 11 Drawing Figures

METHOD OF AUTOMATIC DOFFING IN A SPINNING UNIT

BACKGROUND OF THE INVENTION

The present invention relates to a method of automatic doffing in a textile machine. More specifically, it relates to a method of automatic doffing in a spinning frame or a winder, which permits doffing of a full package and donning of an empty bobbin to be performed by a single operation of a component device provided in an automatic doffing apparatus.

Automation in a spinning mill is a general concern, and a number of automatically-operated devices and improved methods have been contemplated and used for application to various types of spinning machines or winders, accordingly, for the purpose of labor saving, as well as for an increase in productivity. In the field of doffing operations for replacing a full package with an empty bobbin on a spinning unit, various devices and methods have been proposed so far with a view to accomplishing the operation more efficiently so as to reduce the downtime of the respective working units during the doffing operation.

According to a conventional method of doffing, in general, a full package is first removed from a bobbin holder by a doffing device and discharged thereafter to a position where the package will not interfere with the subsequent operation for loading of a new empty bobbin, whereupon the bobbin is placed on the bobbin holder by any suitable means for donning. In this way, the doffing and donning operations according to the conventional method are performed by at least two independent motions of the relevant means or devices. This means that a lot of non-spinning time is consumed during the doffing operation and the structure of the doffing apparatus is complicated, with the result that the operating efficiency at each of the working stations is not only reduced, but also the cost of the doffing apparatus is increased.

SUMMARY OF THE INVENTION

An object of the present invention is therefore to remove the above disadvantages of the conventional method of automatic doffing.

Another object of the invention is to provide a method of automatic doffing by use of which unloading of a full package and the subsequent loading of an empty bobbin may be provided by a single motion of a device provided in an automatic doffing apparatus.

Another object of the invention is to provide a method which contributes to reduction of downtime of the spinning unit during which doffing service is rendered and therefore no spun yarn is produced.

Still another object of the invention is to provide a method which helps simplify the structure of the doffing apparatus.

In a preferred embodiment of automatic doffing method of the invention, the doffing apparatus includes a bobbin loading device which is operated by a cylinder and has a package pushing member at its forward end. As a full package on a spinning unit is disengaged from the grip of a bobbin holder, it is released therefrom and then rests on a take-up drum temporarily. As soon as the package is thus released, the cylinder is actuated to advance the loading device toward the donning position. Before the donning position is reached by an empty bobbin which is carried on the loading device, the package is pushed out of its temporarily-resting position and delivered out from the spinning unit. Then, the empty bobbin is brought to the donning position, where it is held by the bobbin holder. In this way, loading of the bobbin and its preceding unloading of the package may be accomplished by a single advancing motion of the loading device of the doffing apparatus. Because no particular unloading device is used for discharging the package before donning of the bobbin, the apparatus can be made simpler in construction, and also the time spent for one cycle of the doffing operation may be reduced, resulting in advantages in the cost of the apparatus and the operating efficiency of the individual spinning units.

The above and other objects, features and advantages of the present invention will become more readily apparent from the following detailed description of a preferred embodiment thereof, taken in conjunction with the accompanying drawings, wherein:

DETAILED DESCRIPTION OF PREFERRED EMBODIMENT

The following will describe with reference to FIGS. 1 to 11 the structure of the doffing apparatus which may be used for practicing a preferred embodiment of an automatic doffing method of the present invention.

Figure 1:
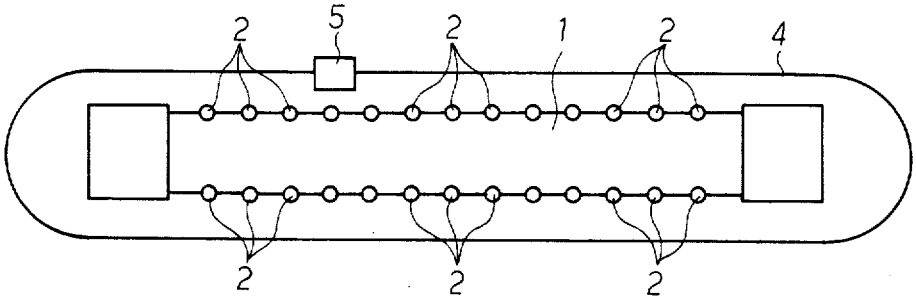
FIG. 1 is a schematic diagram illustrated in plan view, showing a spinning frame having a plurality of spinning units or stations on both sides thereof and a doffing apparatus which travels along the individual spinning units.
Figure 2:
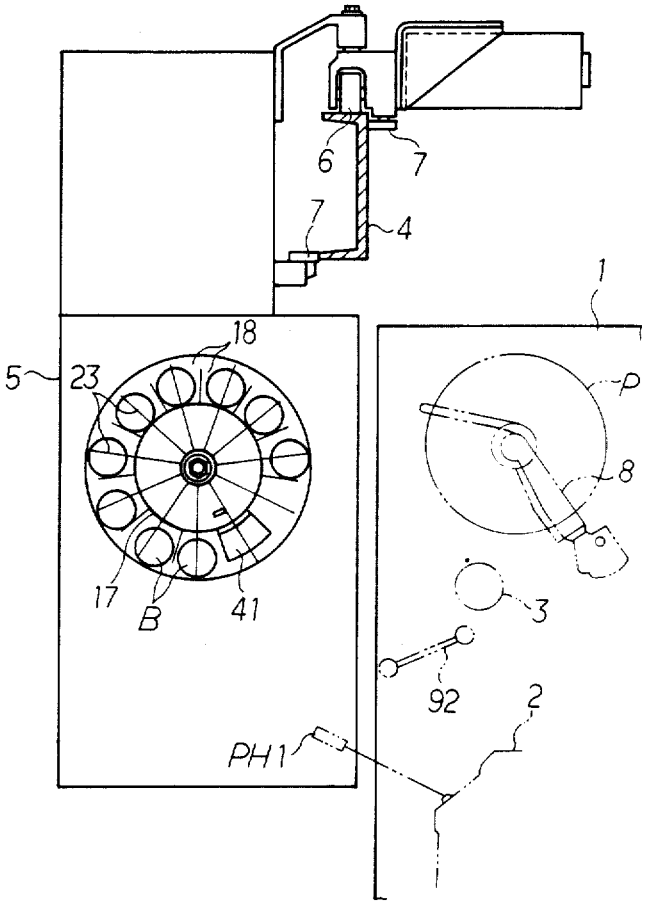
FIG. 2 is a schematic side view showing the positional relationship between the doffing apparatus and a spinning unit in front of which the apparatus is stopped for providing a doffing service to that spinning unit.

Reference is had first to FIGS. 1 and 2. A spinning frame generally designated by the reference numeral 1 comprises a plurality of individual spinning units 2 arranged side by side on each side of the frame and a doffing apparatus 5 movable along the track defined by a rail 4 which is arranged endlessly around the spinning frame. As shown clearly in FIG. 2, the doffing apparatus 5 is supported by the rail 4 in a depending state by way of a driving roller 6 and a guide roller 7. Above the spinning unit 2 on each side of the frame 1 is disposed a take-up drum 3 extending in longitudinal direction of the frame for winding up a spun yarn into a package P. The doffing apparatus 5 is so made that it is caused to stop in front of any one of the spinning units 2 when a sensor such as photoelectric tube PH1 provided on the apparatus detects a light which is emitted from a package-full indicator lamp on the spinning unit 2 when its package P becomes full. The apparatus 5 thus stopped in front of the spinning unit 2 commences its servicing or doffing at that spinning unit.

Figure 3:
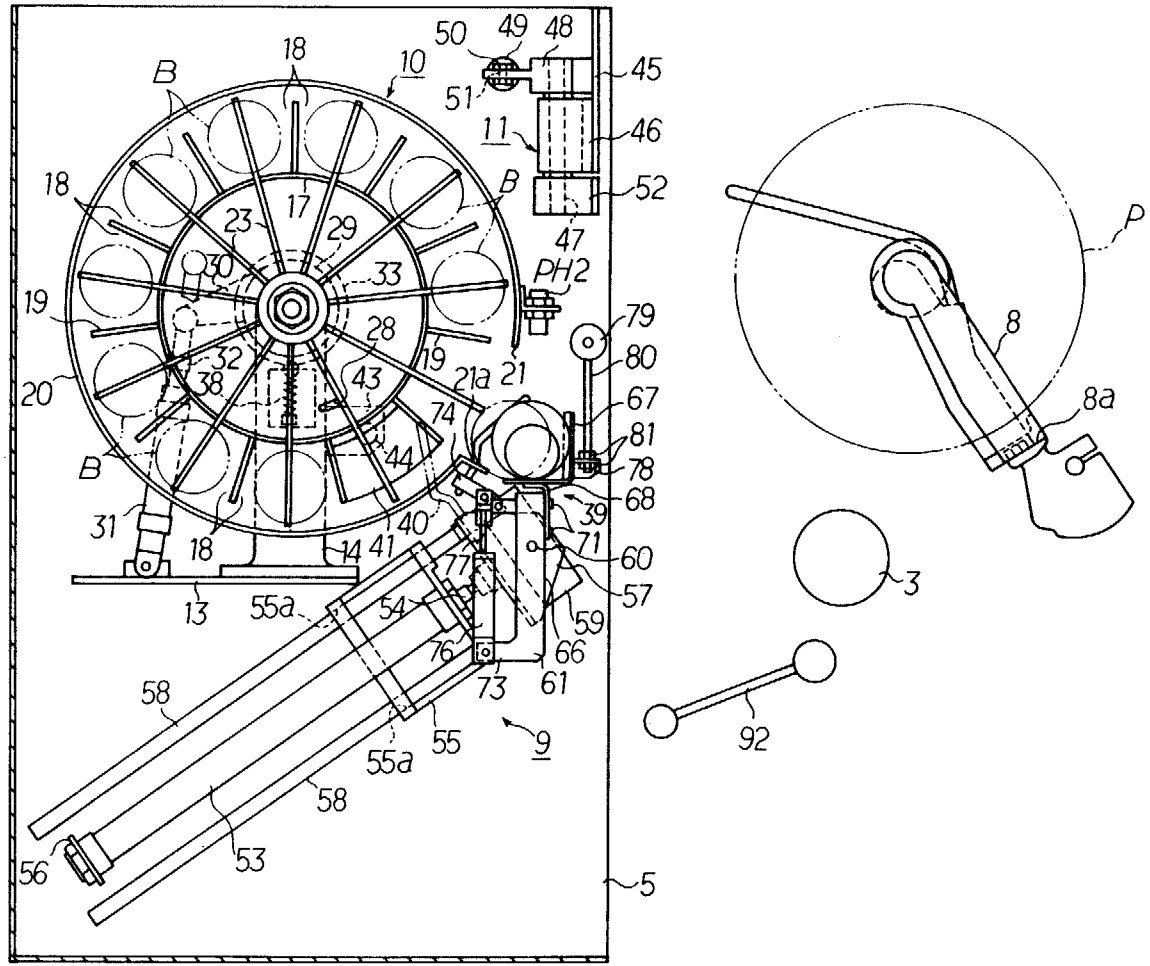
FIG. 3 is a side view of the doffing apparatus, showing its major component devices.

Referring to FIG. 3, the doffing apparatus 5 comprises various component devices including a bobbin loading device 9 for transferring an empty bobbin B to a bobbin holder 8 disposed above each spinning unit 2 and then loading the bobbin in the holder; a bobbin feeding device 10 in the form of a storage magazine for storing a number of bobbins B and feeding one bobbin at a time to the loading device 9; a bobbin holder releasing device 11 for operating on one of the bobbin holder arms to open it, thereby releasing the package P from the bobbin holder 8; and a bobbin holder lowering device 12 (shown in FIGS. 9 and 11) for restoring the bobbin holder 8 from its doffing position to a position where the newly-installed bobbin B is in contact with the take-up drum 3.

Figure 4:
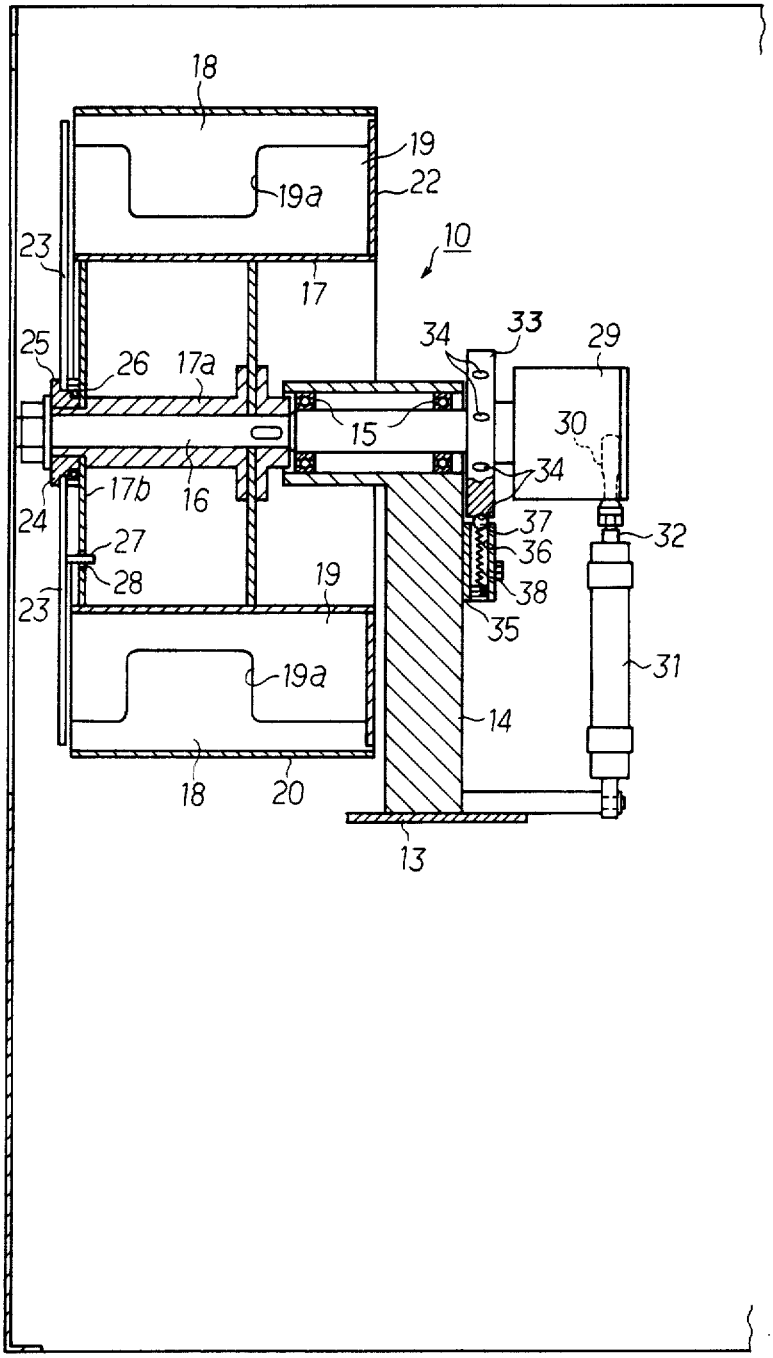
FIG. 4 is a sectional rear view of a bobbin feeding device provided in the doffing apparatus.

The bobbin feeding device 10 is arranged approximately at the center of the doffing apparatus as shown in FIG. 2, and mounted on a rotatable axle shaft 16 which is supported via a bearing 15 by a supporting column 14 secured to a frame 13, as shown in FIGS. 3 and 4. A drum 17 having a length slightly greater than that of the bobbin B is secured on the axle shaft 16 to be rotated therewith in an integral manner. A number of partition plates 19 are mounted radially on the outside periphery of the drum 17 in equidistantly-spaced relation to each other thereby to form a bobbin accommodating compartment 18 between each two adjacent partition plates 19. As shown in FIG. 4, each of the partition plates 19 is formed with a cut opening 19*a* for receiving thereinto a bobbin grasping member 40 of the bobbin loading device 9 which is to be described hereinafter. For preventing the bobbins B from dropping out from their compartments 18 and guiding them during rotation of the drum 17, a cylindrical wall member 20 is concentrically fixed over the drum 17 with a space enough for accommodating the bobbins B. The wall member 20 has a bobbin outlet opening 21 formed on its side facing the spinning unit 2 at such a position where the bobbin B in the compartment 18 adjacent to the outlet opening 21 may roll out therethrough by its own weight, as shown in FIG. 3. The opening 21 is provided with a bobbin guide 21*a* which is formed by bending an end portion of the guide wall member 20. As shown in FIG. 4, one side of the bobbin compartments 18 is closed by a side wall member 22 which is fixed at an edge on the periphery of the drum 17.

The bobbin feeding device 10 further includes a stop member 25 provided on the side of the drum 17 opposite to the side closed by the side wall member 22 for preventing the bobbins B in their compartments 18 from coming out thereof. The stop member 25 includes as many stop bars 23 as the partition plates 19, which stop bars are arranged so as to extend radially from a collar 24 rotatably installed on an end of the shaft portion 17*a* of the drum 17. The collar 24 to which the radial stop bars 23 are fixed is fastened by means of a nut on the end of the shaft portion 17*a* in such a way that an O-ring 26 installed in an annular groove formed on the rear periphery of the collar 24 is pressed against a front side wall member 17*b* of the drum 17, as shown in FIG. 4. The O-ring 26 is pressed against the wall member 17*b* with such a pressure that the stop member 25 may be rotated independently of the drum 17 when thumb pressure is applied to any one of the stop bars 23. As shown in FIG. 4, one of the stop bars 23 is provided with a pin 27 projecting through an elongated hole 28 formed in the wall member 17*b* for permitting the stop bars 23 to be displaced between the stop position (as shown in FIG. 3) where each of the stop bars is located between two adjacent partition plates 19 and the open position where each said stop bar is substantially aligned with each of the partition plates. That is, the bobbin B in its compartment 18 is prevented from coming out thereof by its stop bar 19 in said stop position; the compartment is made accessible in said open position when inserting bobbins into the respective compartments.

Referring to FIGS. 3 or 4, on the opposite end of the axle shaft 16 is mounted a one-way clutch 29 which permits the shaft 16 to be rotated in clockwise direction only as viewed in FIG. 3. The one-way clutch 29 is provided with a lever 30 for actuating the same, which lever 30 is rotatably connected to a piston rod 32 whose cylinder 31 is pivotably supported at its base end. A circular plate 33, on the periphery of which are formed as many locating recesses 34 as the partition plates 19 at equal intervals, is installed fixedly on the axle shaft 16 between the supporting column 14 and the one-way clutch 29. On one side of the column (right-hand side in FIG. 4) is fastened a bracket 35 by means of a bolt at a position adjacent to the circular plate 33, which bracket 35 has a hole 36 formed therein and opened opposite to the peripheral center of the circular plate 33. The hole 36 contains a locating steel ball 37 which is engageable with the locating recess 34 by the biasing force exerted by a spring 38 inserted in said hole. When the steel ball 37 is engaged with any one of the locating recesses 34 on the periphery of the circular plate 33, the drum 17 is positioned where one of the bobbin compartment 18 is aligned with the bobbin outlet opening 21 so that the bobbin B in that compartment may come out thereof through the outlet opening. The bobbin B thus discharged from the feeding device 10 is fed to a bobbin grasping unit 39 of the bobbin loading device 9, which grasping unit is then positioned just in front of the outlet opening 21.

In the above bobbin feeding device 10, in order to permit a bobbin grasping member 40 of the grasping unit 39 to move from its operative position, shown by full line in FIG. 3, to its retracted inoperative position, shown by phantom line, a cut opening (not shown) is preferably formed in the guide wall member 20 at the outlet opening 21, as well as the afore-mentioned cut opening 19*a* in each of the partition plates 19. Furthermore, it is desirable that one of the compartments 18 should be unused for accommodating a bobbin B so that a space may be provided for the grasping member 40 in its retracted inoperative position during replenishing of the feeding device 10 with new bobbins. Accordingly, said one compartment 18 is shut off by a closure plate 41, as shown in FIG. 3, so as to prevent a bobbin from being inserted thereinto by mistake.

Figure 5:
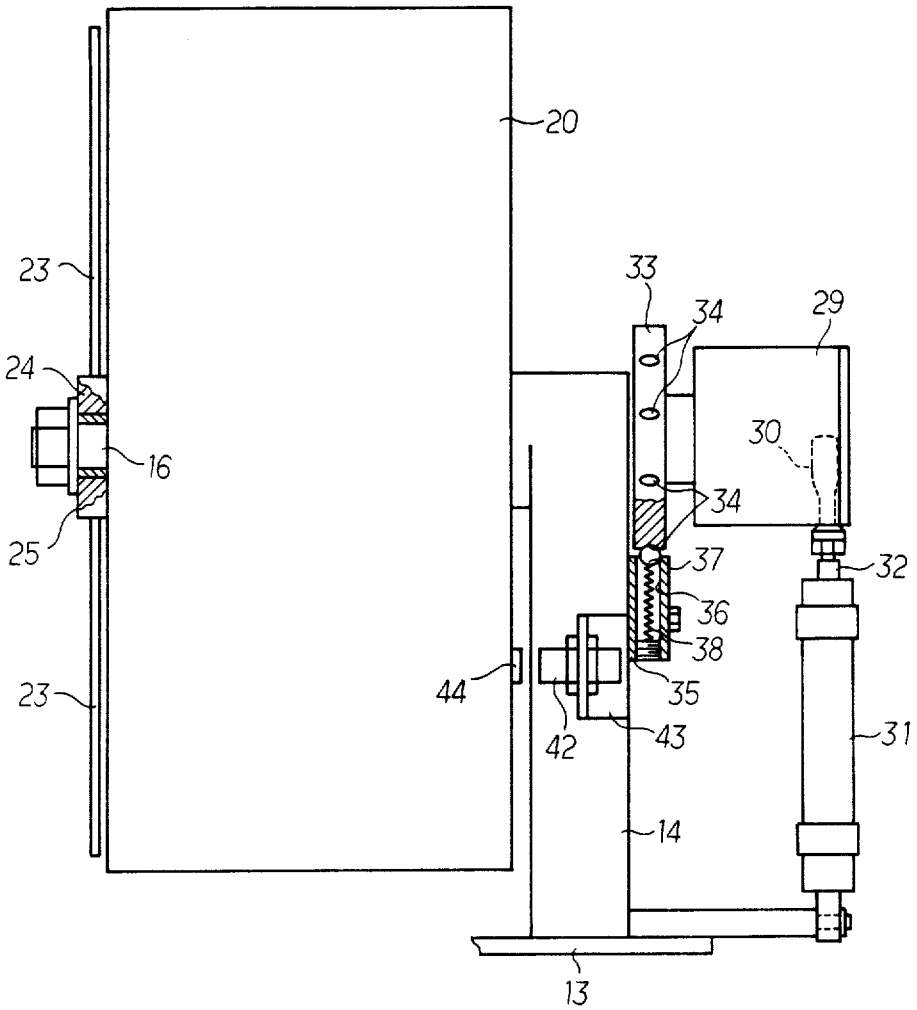
FIG. 5 is a partially cutaway rear view of the bobbin feeding device of FIG. 4.

As shown in FIGS. 3 and 5, a proximity switch 42 is secured to a mounting member 43 which is fixed on one side of the supporting column 14 approximately at the center thereof for ascertaining that the drum 17 has made a complete turn and brought back to its original position. On the other hand, a metallic piece 44 as an actuator for the proximity switch 42 is attached on the outer side of the side wall member 22 at a position just opposite the center of the inner edge of the closure plate 41. When the drum 17 full of bobbins B has rotated a complete turn back to its original position where the metallic piece 44 is positioned just opposite the proximity switch 42, the switch is turned on thereby to energize a warning lamp (not shown) provided on the doffing apparatus 5, whereupon the apparatus is moved back to its bobbin replenishing position at an end of the spinning frame 1.

The bobbin holder releasing device 11 for opening or closing the bobbin holder 8 as required during the doffing operation is disposed above the bobbin feeding device 10 on the side closer to the machine frame 1, as shown in FIG. 3. In this device, a bracket 46 is fixed to a frame 45 which extends in parallel to the longitudinal direction of the spinning frame 1, and the bracket 46 rotatably supports a shaft 47 extending vertically. A lever 48 is provided whose one end is fixed on the upper end of the shaft 47 to be rotated therewith, and whose opposite end is articulated by a pin 51 to the end of a piston rod 50 of a cylinder 49 which is arranged substantially in parallel to the frame 45. On the opposite lower end of the shaft 47, on the other hand, is fixedly mounted a releasing lever 52 which is rotatable with the shaft 47. During the normal inoperative state of the bobbin holder releasing device 11, the piston rod 50 is withdrawn toward the cylinder 49 thereby to keep the releasing lever 52 held in its retracted position within the doffing apparatus 5, as depicted by phantom line in FIG. 6. When the cylinder 49 is actuated to project the piston rod 50, the shaft 47 is turned in counter-clockwise direction, as viewed in FIG. 6, thereby to turn the releasing lever 52 to its operative position, shown by full line, where it is engaged with a bar portion **8*b* of the bobbin holder 8** and therefore an arm of the holder is opened.

The bobbin loading device 9 for transferring a bobbin B to a donning position in the spinning unit 2 is arranged just below the bobbin feeding device 10, as shown in FIG. 3. This device 9 includes a doffing cylinder 53 and its associated piston rod 54 for moving a bobbin grasping unit, generally designated by the reference numeral 39, toward and away from the bobbin holder 8 which is then lifted in its doffing position. The doffing cylinder 53 is fixed to a frame (not shown) of the doffing apparatus 5 by way of a bracket 55 and a mounting piece 56 in an inclined position so as to allow its piston rod 54 to project out obliquely upwards.

Figure 7:
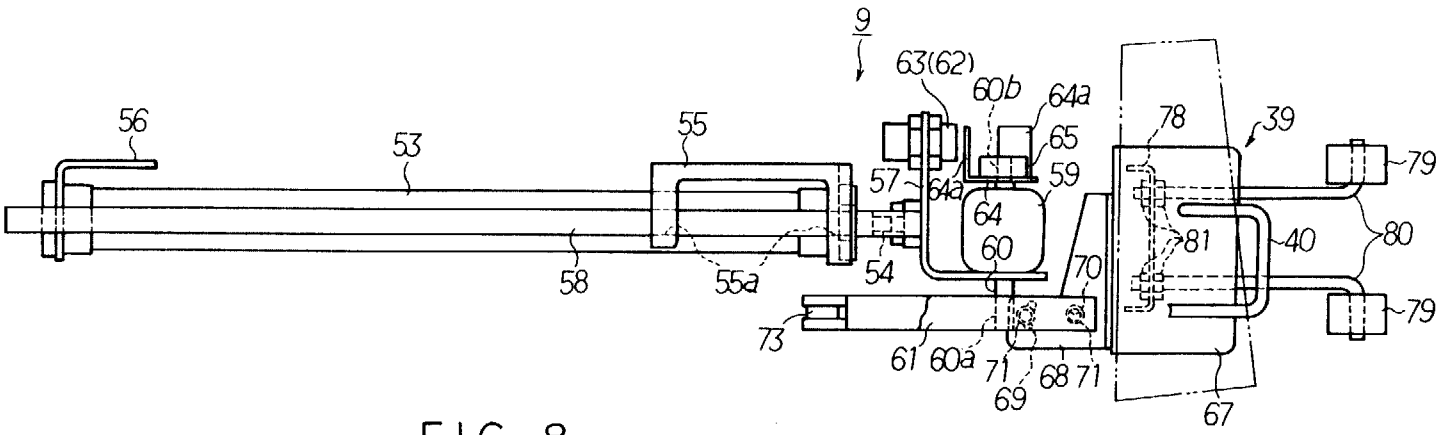
FIG. 7 is a plan view of a bobbin loading device arranged in the doffing apparatus.
Figure 8:
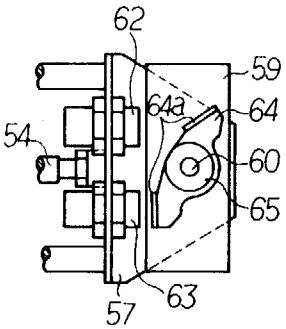
FIG. 8 is an enlarged rear view of a rotary cylinder in the bobbin loading device of FIG. 7.

At the end of the piston rod 54 is fixed a mounting member 57 having an L-shaped section, as shown in FIG. 7. A guide rod 58 extending in parallel to the cylinder 53 and passed through guide holes **55*a* formed in the bracket 55 is fixed to the back side (or left-hand side as viewed in FIG. 7) of the L-shaped mounting member 57. On the opposite front side thereof is fixed a rotary cylinder 59 with its rotatable shaft 60 extended in parallel to the axle shaft 16 of the bobbin feeding device 10. A bracket 61 for mounting the bobbin grasping unit 39 is fitted on the outwardly projecting end 60*a* of the shaft 60 of the rotary cylinder 59. Furthermore, a pair of proximity switches 62, 63 are installed on the front side of the L-shaped mounting member 57, as clearly shown in FIG. 8. The aforementioned shaft 60 has the inwardly projecting end 60*b* having a member 65 which is fixed thereon for rotation with said shaft 60, and a metallic piece 64 having a pair of bent portions 64*a* which may be brought in confrontation with said pair of proximity switches 62, 63 alternately is attached to said member 65 rotatable with the shaft 60 of the rotary cylinder 59**.

The above-mentioned bracket 61 is formed with a mounting face 66 which may be positioned substantially in parallel to a mounting face **8*a* of the bobbin holder 8 by the operation of the rotary cylinder 59 during the presenting and donning of an empty bobbin B on the bobbin holder. An L-shaped bobbin supporting member 67 for receiving a bobbin B fed from a bobbin compartment 18 through the outlet opening 21 and then supporting the same on the inside of its L-shape is mounted on said mounting face 66 of the bracket 61 via an L-shaped intermediate bracket 68. As shown in FIG. 7, the intermediate bracket 68 has an elongaged hole 69 and a circular hole 70 therein for receiving screws 71 which fasten the bracket 68 to the mounting face 66 of the bracket 61, thus making possible adjustment of the bobbin supporting member 67 with respect to the bracket 66**.

As shown in FIG. 3, the bracket 61 includes supporting projections 72, 73 at its ends on the side opposite to the mounting face 66. A lever 74 having the bobbin grasping member 40 with a U-shaped configuration fixed thereto at one end thereof is pivotably connected to the upper supporting projection 72 by a pin 75, and the base end of a cylinder 76 having a piston rod 77 whose end is articulated to said lever 74 at its intermediate position is pivotably connected to the lower supporting projection 73.

The bracket 61 is normally positioned upright such that the inside of the L-shape of the bobbin supporting member 67 faces the bobbin outlet opening 21 with a bobbin B placed on said supporting member, said bobbin B being detected by a sensor such as photoelectric tube PH2 which is secured on the guide wall member 20 at a position just above the supporting member 67. The cylinder 76 which is actuatable from a signal emitted by the photoelectric tube PH2 is operated so as to project its piston rod 77, so that the bobbin grasping member 40 is placed in engagement with the bobbin B on the supporting member 67, as shown by solid line in FIG. 3.

A bracket 78 is fixed to the bobbin supporting member 67 on the outside of its L-shape, and a pair of package pushing members 80 each having a pusher roller 79 mounted rotatably at one end thereof are fastened to said bracket 78 by nuts 81 in such a way that the members 80 extends substantially in parallel to the mounting face 66 of the bracket 61.

Figure 9:
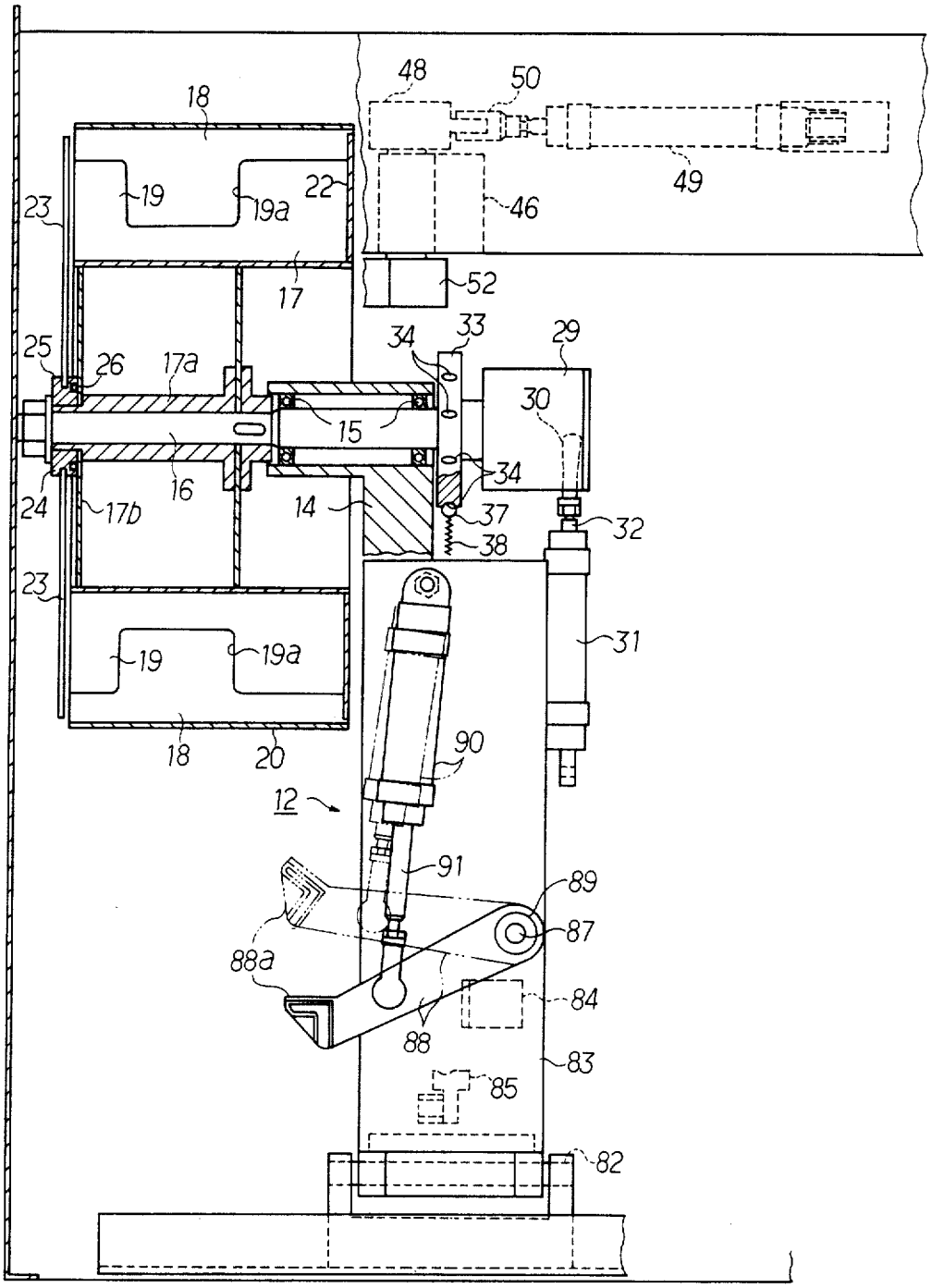
FIG. 9 is a rear view of a bobbin holder lowering device provided in the doffing apparatus.
Figure 11:
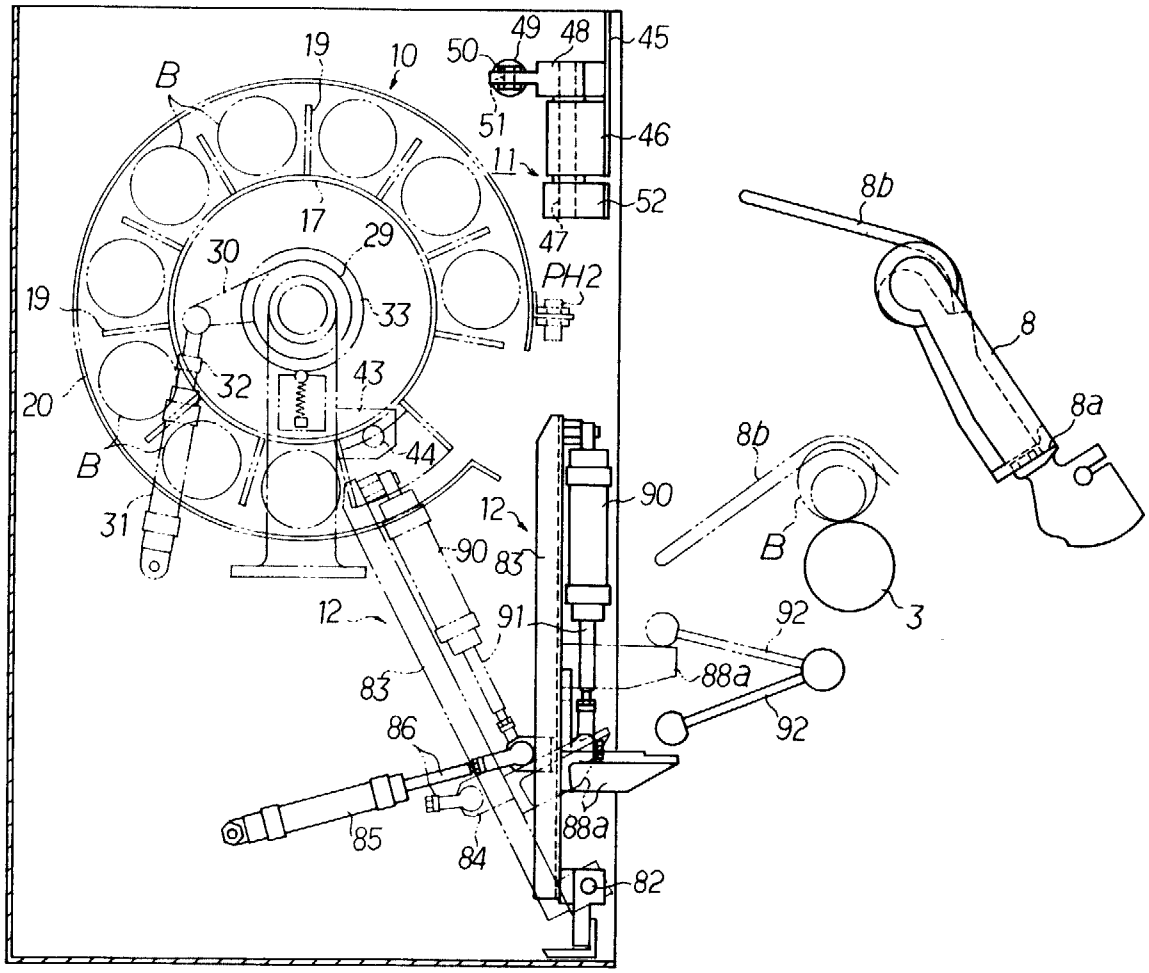

The device 12 for lowering the bobbin holder 8 from the doffing position to a position where it is in contact with the take-up drum 3 after each doffing operation is over is arranged below the bobbin holder releasing device 11, as shown in FIGS. 9 and 11. This bobbin holder lowering device 12 includes a supporting member 83 which is pivotably supported at its base end by a shaft 82 extending substantially in parallel to the axle shaft 16 in the bobbin feeding device 10. A cylinder 85 is provided which has its base end pivotably connected to a stationary frame (not shown) of the doffing apparatus 5 and has a piston rod 86 whose end is rotatably connected to a bracket 84 which is secured on the front side (or left-hand side as viewed in FIG. 11) of said supporting member 83. The supporting member 83 includes a shaft 87 projecting from the back side thereof in a direction perpendicular to the shaft 82, on which shaft 87 a lever 88 is rotatably mounted via a bearing 89. The supporting member 83 further includes a cylinder 90 whose base end is rotatably mounted adjacent to the upper end of said supporting member and which has a piston rod 91 having its end rotatably connected to the lever 88 at its intermediate position. The lever 88 has a portion 88*a* engageable with an actuating lever 92 which is provided on the side of the spinning unit 2 for controlling the operation of a drive mechanism (not shown) for lowering the bobbin holder 8. This bobbin holder lowering device 12 is normally so positioned that its supporting member 83 is tilted as indicated by phantom line in FIG. 11 and the portion 88*a* of the lever 88 is placed in its down position. That is, the entire device is retracted within the doffing apparatus 5.

A preferred embodiment of a doffing method according to the present invention which may be carried out in the above-described arrangement will be now explained.

When all the bobbins B in the bobbin feeding device 10 have been used for doffing, the drum 17 is placed in its original position as shown in FIG. 3. When replenishing the feeding device with new empty bobbins, the stop member 25 is shifted so that each of the stop bars 23 may be brought in alignment with each of the partition plates 19 to permit access to each bobbin compartment 18. In this position, new bobbins B are inserted into the respective compartments 18. After the feeding device has become full of new bobbins B, the stop member 25 is turned back to its normal stop position where the stop bars 23 keep the bobbins B from coming out of the compartments 18. Replenishment of the feeding device 10 is thus completed.

During the above replenishing, the bracket 61 of the bobbin grasping unit 39 is positioned upright so that the bobbin supporting member 67 confronts the bobbin outlet opening 21, as shown in FIG. 3, and the bobbin grasping member 40 is held in its retracted position (shown by phantom line) with the piston rod 77 withdrawn in the cylinder 76. The bobbin B in the compartment 18 which is closest to the outlet opening 21 is discharged out thereof past the guide 21*a* onto the bobbin supporting member 67. As soon as the bobbin B is placed on the supporting member, the photoelectric tube PH1 is turned on thereby to provide a signal for actuating the cylinder 76. Accordingly, the piston rod 77 is advanced to cause the lever 74 to be turned clockwise (as viewed in FIG. 3), so that the bobbin grasping member 40 is turned in the same direction as as the lever 74 to its operative or bobbin grasping position (shown by full line in FIG. 3). In this way, the bobbin B resting on the supporting member 67 is securely held by the grasping member 40.

Figure 6:
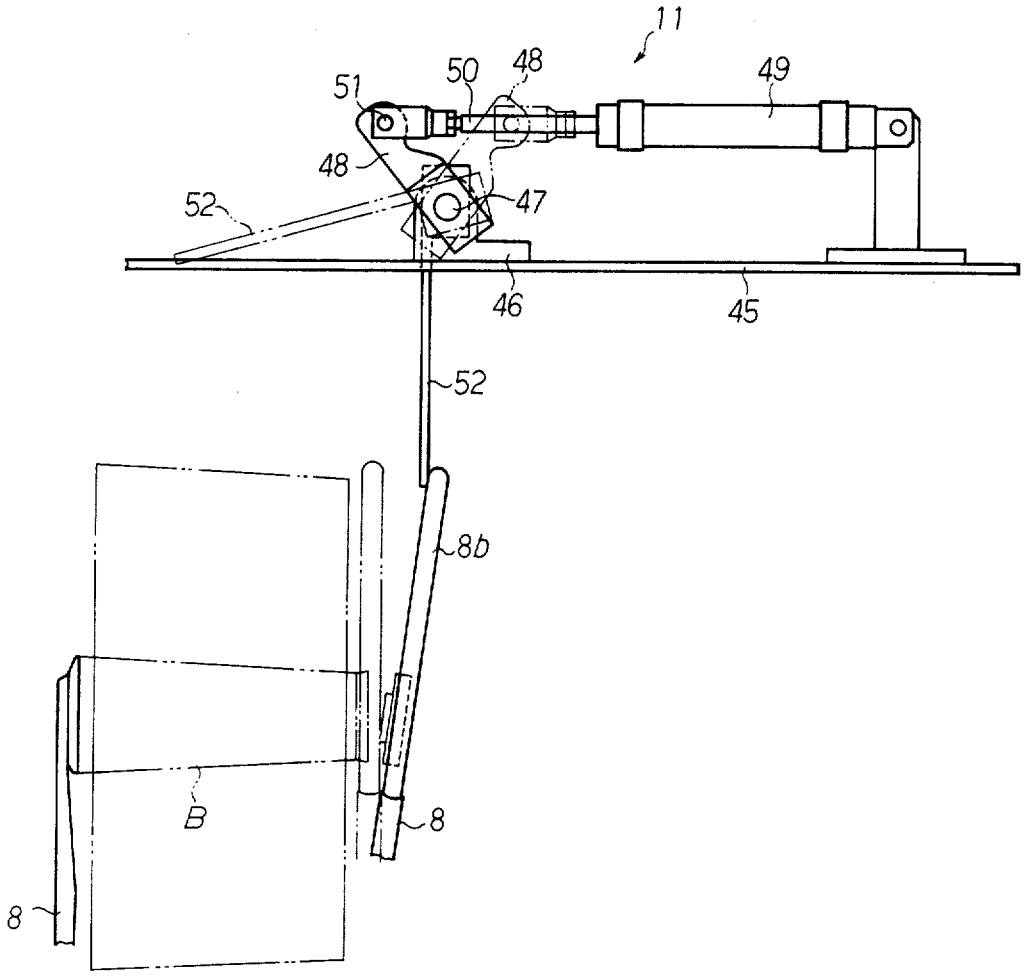
FIG. 6 is a plan view of a bobbin holder releasing device provided in the doffing apparatus.
Figure 10:
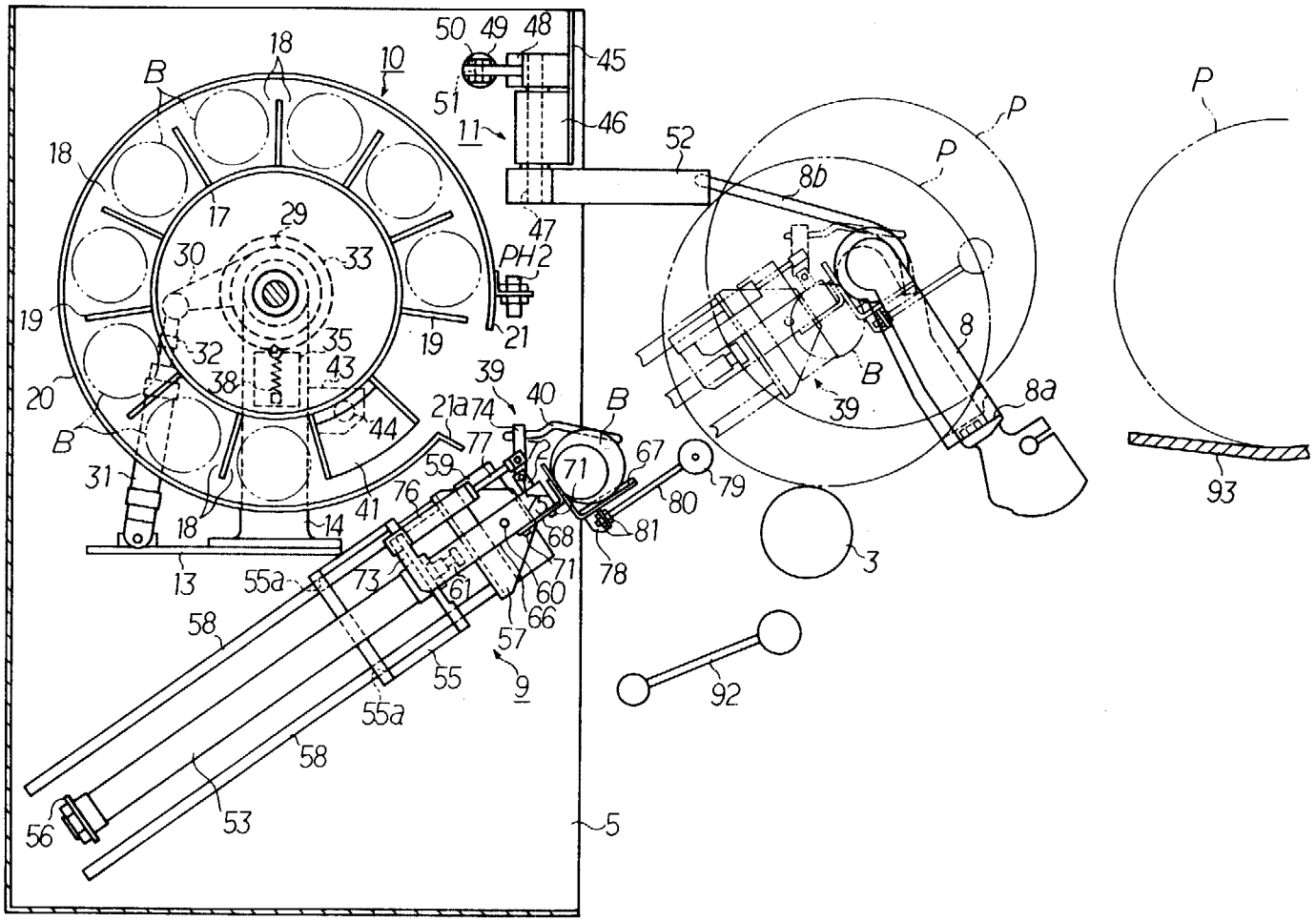
FIGS. 10 and 11 are front views showing the manner of operation of the devices in the doffing apparatus, respectively.

Subsequently, the doffing apparatus 5 commences to travel along the track of the rail 4 arranged around the spinning frame 1. As the apparatus 5 comes to a spinning unit 2 whose package-full lamp is illuminated, it is caused to stop in front of that spinning unit in response to a package-full signal transmitted when the photoelectric tube PH1 detects the illumination of the lamp. Then, the rotary cylinder 59 is actuated to turn the bracket 61 from its upright position to where the mounting face 66 of the bracket 61 is set in parallel to the mounting face 8*a* of the bobbin holder 8 (FIG. 10). Thereafter, the cylinder 49 for the bobbin holder releasing device 11 is actuated to advance its piston rod 50, rotating the vertical shaft 47 so that the releasing lever 52 is turned from its inoperative position (phantom line in FIG. 6). Just before the full-line position in FIG. 6 is reached, the end of the lever 52 is brought in engagement with the bar portion 8*b* and thereby causes the bobbin holder 8 to be opened against the influence of a force exerted by a spring (not shown). As the bobbin holder 8 is thus disengaged from the bobbin B, the package P on the bobbin is released from the holder and rests on the take-up drum 3 which is positioned just below the package, as shown in FIG. 10.

Then, the doffing cylinder 35 of the bobbin loading device 9 is operated to advance the bobbin grasping unit 39, which carries the bobbin B on the supporting member 67, toward the donning position. Since the package P just released from the bobbin holder 8 and resting on the take-up drum 3 lies in the way of the pusher rollers 79 which are movable with the grasping unit 39, the advancing motion of the grasping unit causes the package P to be pushed away by the pusher rollers 79 and discharged out onto a package delivery conveyor 93 which is arranged on the back side of the bobbin holder 8. It should be noted here that the doffing cylinder 53 is so arranged that it is operable only after the bracket 61 has made the above-stated turning motion thereby energizing the proximity switch 63.

As the grasping unit 39 of the bobbin loading device 9 reaches the donning position which is represented by phantom line in FIG. 10, the cylinder 49 is operated to retract its piston rod 50. Simultaneously, the releasing lever 52 is returned to its original position, allowing the bobbin holder 8 to be closed under the influence of the force of the aforementioned spring. Thus, the bobbin B in the grasping unit 39 is held securely by the bobbin holder 8.

After the donning position is reached by the bobbin grasping unit 39, but before the bobbin holder releasing device 11 is operated to close the bobbin holder 8, the cylinder 85 in the bobbin holder lowering device 12 is actuated to advance its piston rod 86, so that the device 12 is turned to its operative position, which is shown by full line in FIG. 11, and held there.

After the bobbin B is chucked or held by the bobbin holder 8, the cylinder 76 is operated so as to turn its bobbin grasping member 40 in counter-clockwise direction (as viewed in FIG. 10) so that the bobbin B may be released therefrom. Subsequently, the doffing cylinder 53 is actuated to retract its piston rod 54 and therefore the bobbin grasping unit 39 is also retracted to the position which is shown by full line in FIG. 10, but having no bobbin therein. Then, the cylinder 76 is actuated again to turn the grasping member 40 back to its operative position. With the member 40 held in this position, the rotary cylinder 59 is actuated, allowing the bobbin grasping unit 39 to resume its original upright position. Thereafter, the cylinder 76 is operated again in such a way as to turn the bobbin grasping member 40 to its inoperative position within the bobbin feeding device 10, as shown by phantom line in FIG. 3.

In this way, one complete cycle of the doffing operation is over. The reason for keeping the bobbin grasping member 40 in its operative position in actuating the rotary cylinder 59 to turn the bobbin grasping unit 39 to its upright position is to avoid the mechanical interference between the grasping member 40 and a guide member (not shown) provided in the vicinity of the bobbin outlet opening 21.

As the bobbin grasping unit 39 resumes its original position, the cylinder 90 for the bobbin holder lowering device 12 is operated to retract the piston rod 91, thereby causing the lever 88 to turn in clockwise direction as viewed in FIG. 9. Therefore, the portion 88*a* of the lever 88 is moved upwards, which in turn causes the lever 92 to swing in clockwise direction as viewed in FIG. 11. This movement of the lever 92 energizes a driving mechanism (not shown) for the bobbin holder 8, whereby the lifted bobbin holder is swung down until the newly-loaded bobbin B is brought into a contact with the take-up drum 3. Then, the cylinder 90 is operated again to return the lever 88 to its original position, whereupon the cylinder 85 is operated to bring the lowering device 12 back to its inoperative position shown by phantom line in FIG. 11.

On the other hand, as the bobbin grasping unit 39 resumes its original position within the doffing apparatus 5, the cylinder 31 in the bobbin feeding device 10 is operated to advance its piston rod 32, causing the lever 30 attached to the one-way clutch 29 to turn a predetermined distance in clockwise direction as viewed in FIG. 3. Accordingly, the axle shaft 16 of the drum 17 is turned together with the circular plate 33 in the same direction as the lever 30. Engagement of one of the locating recesses 34 with the steel ball 37 is released by such turning of the plate 33, and said plate continues to turn until the steel ball 37 is engaged with the next locating recess, in which position of the plate the next compartment 18 is brought to the bobbin outlet opening 21 and the bobbin B in that compartment is discharged out thereof.

As the bobbin B rolls down onto the bobbin supporting member 67 of the grasping unit 39, the cylinder 76 is operated in response to a signal provided from the photoelectric tube PH2. As stated earlier, the grasping member 40 is thereby turned to grasp the bobbin securely in conjunction with the supporting member 67, whereupon the doffing apparatus 5 starts to travel again. The operations described in the above are repeated at the other spinning units whenever any one of them calls for the doffing service thereby.

As is now apparent from the foregoing, according to the doffing method of the invention a full package released from the bobbin holder is placed adjacent to the bobbin holder, and is thereafter discharged out of the doffing area by a pushing member which is attached to a bobbin loading device which carries a new empty bobbin therein and presents it to the donning position. Because the package discharging can be accomplished only by the forward movement of the loading device provided in the doffing apparatus, the time spent before the loading device starts to move for donning after the doffing area has been cleared of the released package may be eliminated. Since discharging of a package and loading of a new bobbin is achieved by a single motion of the bobbin loading device and therefore no specific device for package discharging is required, the time for the doffing operation or bobbin exchanging may be reduced and also the doffing apparatus can be made simpler than heretofore.

While the invention has been illustrated and described with reference to specific embodiment thereof, it is to be understood that various changes or modifications in the details may be made without departing from the spirit and scope of the invention.

What is claimed is:

1. A method for automatically and substantially contemporaneously doffing a full-yarn package from, and donning an empty bobbin on the bobbin holder of a yarn spinning unit, comprising the steps of:

releasably grasping said empty bobbin in a bobbin grasping unit mounted on a bobbin loading device while said bobbin loading device is in a first position thereof spaced away from said bobbin holder;

opening said bobbin holder and thereby doffing said full-yarn package onto a support therebelow;

moving said bobbin loading device, carrying said grasped empty bobbin therein, from its said first position to a second position thereof wherein said carried empty bobbin is positioned within said opened bobbin holder;

said full-yarn package while on said support being within the path of movement of said bobbin loading device from its said first position to its said second position;

said bobbin loading device during said movement from its first position to its second position engaging and pushing said full-yarn package from said support onto a package delivery conveyor for conveying of said full-yarn package away from said bobbin holder;

closing said bobbin holder and releasing said empty bobbin from said bobbin grasping unit while said bobbin loading device is in its said second position, and thereby donning said empty bobbin on said bobbin holder;

and then moving said bobbin loading device from its said second position to its said first position.

2. A method according to claim 1, wherein said bobbin loading device moves with translatory movement between its said first and second positions.

3. A method according to claim 2, wherein the path of said translatory movement of said bobbin loading device from its said first position to its said second position is obliquely upward.

4. A method according to claim 1, wherein said full-yarn package support is the yarn take-up drum of said yarn spinning unit.

5. A method according to claim 4, which further comprises the step of moving said bobbin holder, having said empty bobbin thereon, towards said yarn take-up drum to engage said empty bobbin with said take-up drum after said bobbin loading device has moved from its said second position towards its said first position.

6. In a yarn spinning machine having a plurality of yarn spinning units thereon, an equal plurality of yarn bobbin holders respectively associated with said yarn spinning units, and a bobbin doffing and donning apparatus mounted for traveling movement on said yarn spinning machine between, and for doffing a full-yarn package from and donning an empty bobbin on, the respective of said bobbin holders, said doffing and donning apparatus having an empty bobbin feeding device thereon, the improvement comprising:

a bobbin loading device comprising an openable and closable empty bobbin grasping unit;

means mounting said bobbin loading device on said doffing and donning apparatus for translatory, reciprocal movement between a retracted position substantially within said doffing and donning apparatus and wherein said bobbin grasping unit is adjacent to said empty bobbin feeding device for receiving an empty bobbin therefrom, and a projected position away from said apparatus and wherein said bobbin grasping unit is adjacent to one of said bobbin holders for donning said empty bobbin thereon;

means for releasing a full-yarn package from each said bobbin holder;

a yarn take-up roller associated with and disposed below each said bobbin holder for supporting said full-yarn package when released therefrom; and full-yarn package conveyor means disposed adjacent to each said yarn take-up roller for receiving said released full-yarn package from the latter, each said released full-yarn package while supported on its said yarn take-up roller being disposed within the path of said translatory movement of said bobbin loading device between its said retracted and projected positions whereby, during said movement of the bobbin loading device from its said retracted position to its said projected position, said bobbin grasping unit pushes said full-yarn package from said yarn take-up roller onto said adjacent full-yarn package conveyor means.

7. In a yarn spinning machine, the improvement according to claim 6, wherein said bobbin loading device further comprises full-yarn package pusher means on said bobbin grasping unit projecting in the direction of said projected position of the bobbin grasping unit, said pusher means pushing said full-yarn package during said movement of said bobbin loading device from its said retracted position to its said projected position.

8. In a yarn spinning machine the improvement according to claim 7, wherein said pusher means comprises a roller for engaging said full-yarn package.

9. In a yarn spinning machine the improvement according to claim 6, wherein said means for mounting said bobbin loading device comprises guide rail means attached to said doffing and donning apparatus below said empty bobbin feeding device and inclined upwardly in the direction of said projected position of the bobbin loading device.

10. In a yarn spinning machine the improvement according to claim 9, wherein said bobbin grasping unit comprises a bobbin supporting member mounted for pivotal movement between a first position facing said bobbin feeding device for supporting an empty bobbin received therefrom, and a second position facing said bobbin holder, and a bobbin grasping member mounted adjacent to said bobbin supporting member for pivotal movement between a bobbin grasping position for grasping an empty bobbin in said bobbin supporting member, and an open position with respect to said bobbin supporting member, and said improvement further comprises:

means for pivoting said bobbin grasping member from its said open position to its said bobbin grasping position when an empty bobbin is in said bobbin supporting member, and means for pivoting said bobbin supporting unit from its said first position to its said second position substantially concurrently with the initiation of said movement of said bobbin grasping unit from its said retracted position towards its said projected position.

11. In a yarn spinning machine the improvement according to claim 10, which further comprises:

means for sensing an empty bobbin in said bobbin supporting member when said bobbin grasping unit is in its said retracted position, and means for actuating said bobbin grasping member pivoting means responsive to said sensing means, to pivot said bobbin grasping member from its said open position to its said bobbin grasping position.

* * * * *